United States Patent [19]

White

[11] Patent Number: 4,498,292

[45] Date of Patent: Feb. 12, 1985

[54] IGNITER FOR ROCKET MOTORS

[75] Inventor: C. Max White, Brigham City, Utah

[73] Assignee: Thiokol Corporation, Chicago, Ill.

[21] Appl. No.: 463,102

[22] Filed: Feb. 2, 1983

[51] Int. Cl.[3] ..... F02K 9/08

[52] U.S. Cl. ..... 60/256; 60/39.821; 60/39.823; 102/202

[58] Field of Search ..... 60/256, 39.821, 39.823; 102/202

[56] References Cited

U.S. PATENT DOCUMENTS

| | | | |
|---|---|---|---|
| 2,685,837 | 8/1954 | Sage et al. | 102/202 |
| 2,771,212 | 11/1956 | Effinger Jr. | 60/256 |
| 2,942,547 | 6/1960 | Rabern et al. | 60/256 |
| 3,101,590 | 8/1963 | Hagerty | 60/39.823 |
| 3,151,447 | 10/1964 | Bornstein | 60/256 |
| 3,332,353 | 7/1967 | Burkhardt et al. | 60/256 |
| 3,570,405 | 3/1971 | Heady, Jr. | 60/256 |
| 3,667,396 | 6/1972 | Barrett | 60/256 |

*Primary Examiner*—Louis J. Casaregola
*Assistant Examiner*—Donald E. Stout
*Attorney, Agent, or Firm*—Gerald K. White

[57] ABSTRACT

A consumable wafer-like igniter for high-performance rocket motors having a full, head-end web of propellant in the forward end of the motor includes a hat-shaped urethane housing. The housing comprises a flat disk attached to one end of a short cylinder, a flange being attached to the other end for attachment of the igniter directly to the rocket motor propellant. A disk of solid propellant attached to the inside of the housing disk has holes formed therein and has radial grooves in the surface facing the rocket motor propellant for directing gases from the burning propellant through holes that are provided in the peripheral surface of the cylinder. A liner on the inside surface of the cylinder has holes that are in alignment with the holes in the cylinder but which, normally, are smaller. An igniter initiator having a tubular urethane housing is positioned adjacent the solid propellant disk. Upon ignition of the solid propellant disk, as the internal pressure within the igniter becomes greater, the holes in the liner expand, releasing the hot gases in a smoothly increasing volume thereby to provide rapid and reliable ignition of the rocket motor propellant before the igniter is consumed by combustion or becomes detached from the rocket motor propellant due to erosion of the latter.

10 Claims, 3 Drawing Figures

IGNITER FOR ROCKET MOTORS

The Government has rights in this invention pursuant to Contract No. FO4611-80-C-0031 awarded by the U.S. Air Force.

BACKGROUND OF THE INVENTION

1. Field of the Invention

The present invention relates to an improvement in igniters for solid fuel rocket motors, and has particular application in high performance solid fuel rocket motors having full, head-end propellant webs.

2. Description of the Prior Art

The conventional igniter for large solid fuel rocket motors is a miniature rocket motor that is known in the art as a "pyrogen" igniter. Typically, a pyrogen igniter is mounted in the forward end of a motor through a hole in the propellant. In some high-performance rocket motors, however, a pyrogen igniter is impractical because of the full, head-end web of the propellant in the forward end of the motor. The head-end web propellant grain design provides a higher mass fraction; additionally, it minimizes nozzle throat size, which, in turn, maximizes the nozzle expansion ratio within the motor length envelope and minimizes insulation weight.

An igniter for such high performance rocket motors must be attached to, that is, mounted on, the forward portion of the propellant, itself, thereby to provide the ignition source of heat as close as possible to the surface to be ignited. Upon ignition of and burning of the propellant, however, the support for the igniter is eroded. This causes the igniter to become detached from the propellant and presents a problem of possible resultant damage to the rocket motor nozzle or the propellant. Therefore, in order to avoid such damage, the igniter must be substantially consumed before becoming detached from the propellant. Additionally, the igniter must perform its intended function of igniting the propellant before it is consumed.

SUMMARY OF THE INVENTION

An object of the invention is to provide an igniter for rocket motors having especial utility in igniting solid fuel rocket motors having full, head-end webs.

A more specific object of the invention is to provide such an igniter which is adapted for attachment to the forward portion of the propellant grain of such rocket motors and which, when activated to ignite the propellant, is consumed before becoming detached from the propellant.

A further specific object of the invention is to provide such an igniter that is operative to provide reliable ignition of the rocket motor propellant before it is consumed.

Another specific object of the invention is to provide a consumable wafer-like igniter that is operative, when activated, to release hot gases for igniting the rocket propellant in a smoothly increasing volume, rather than with a sudden impulse.

In accomplishing these and other objectives of the invention, there is provided an igniter for rocket motors comprising a thin hat-shaped urethane housing. The housing is made of a disk that is attached to one end of a short cylinder. The other end of the cylinder is attached to a flange by which the housing may be mounted on the rocket motor propellant grain, as by bonding or other suitable means.

A circular piece of woven glass fiber is bonded to the inside surface of the housing disk, and a flat circular piece or disk of solid propellant is partially bonded to the piece of fiber glass cloth. A number of holes are formed in the propellant disk to promote rapid burning. Radial grooves are formed in the surface of the propellant disk that is adjacent the surface of the rocket motor propellant grain to direct hot gases from the burning propellant disk through holes that are provided in the cylindrical or peripheral portion of the igniter housing.

The inner wall of the cylindrical portion of the housing is lined with a sheet of EPDM, a terpolymer elastomer made from ethylene-propylene diene monomer elastomer. The EPDM sheet has a number of small holes, each of which is located in the center of an individually associated one of the holes in the peripheral portion of the igniter housing, the latter holes being substantially larger than the holes in the EPDM sheet. The relatively smaller holes in the EPDM sheet perform the function of retaining the gas pressure within the housing until that pressure is great enough to project flaming gases onto the surface of the rocket motor propellant over the required area. As the internal pressure within the igniter housing becomes greater, the holes in the EPDM sheet expand, releasing the hot gases in a smoothly increasing volume.

An initiator is provided for the igniter comprising a tubular urethane housing that is filled with pellets made of a mixture of boron and potassium nitrate. Each end of the tube is sealed with an epoxy plug that confines a pair of styrofoam disks. Sandwiched between each pair of disks is the end of a fuze that is surrounded by boron and potassium nitrate in powder form. Each fuze leads to an ordnance initiator that is fixed to the case of the rocket motor. The ordnance initiators are fired by an externally initiated, confined detonating fuze.

DESCRIPTION OF THE DRAWINGS

Having summarized the invention, a detailed description follows with reference being had to the accompanying drawings which form part of the specification, of which.

DESCRIPTION OF THE PREFERRED EMBODIMENTS

Figure 1:
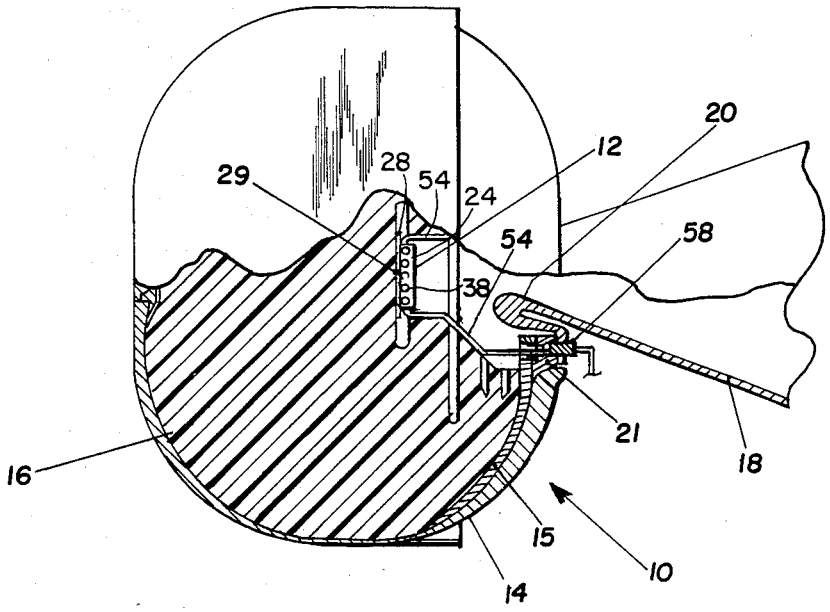
FIG. 1 is a partial cross sectional view showing the igniter of the present invention installed in a high performance rocket motor having a full, head-end-web grain.

Referring to FIG. 1 of the drawings, the numeral 10 designates a high performance rocket motor in which a consumable wafer-like igniter 12 according to the present invention is embodied. The rocket motor 10 includes a rocket case 14 containing a rocket propellant 16, a suitable liner 15 being provided between case 14 and propellant 16. The rocket propellant 16, as illustrated, has a full, head-end-web grain, that is to say, it completely fills the head or forward end of the rocket motor case 14. The rocket motor 10 further includes a semi-submerged nozzle 18 of the convergent-divergent type having a throat 20, the nozzle 18 being attached to the case 14 by a polar boss 21.

Figure 2:
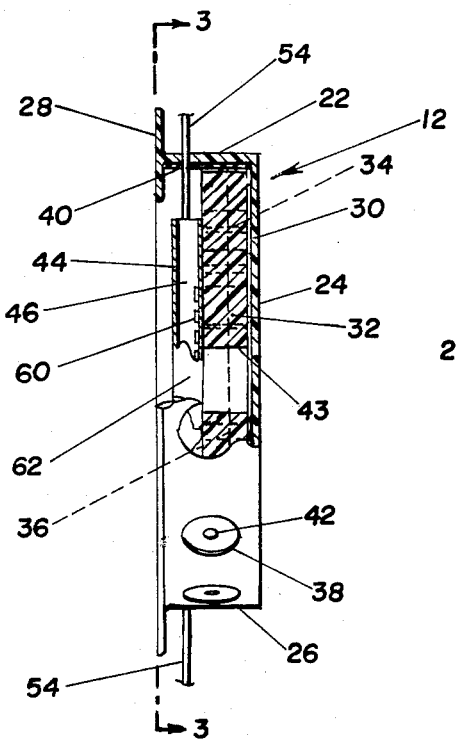
FIG. 2 is a partial cross sectional edge view of the igniter of the present invention.
Figure 3:
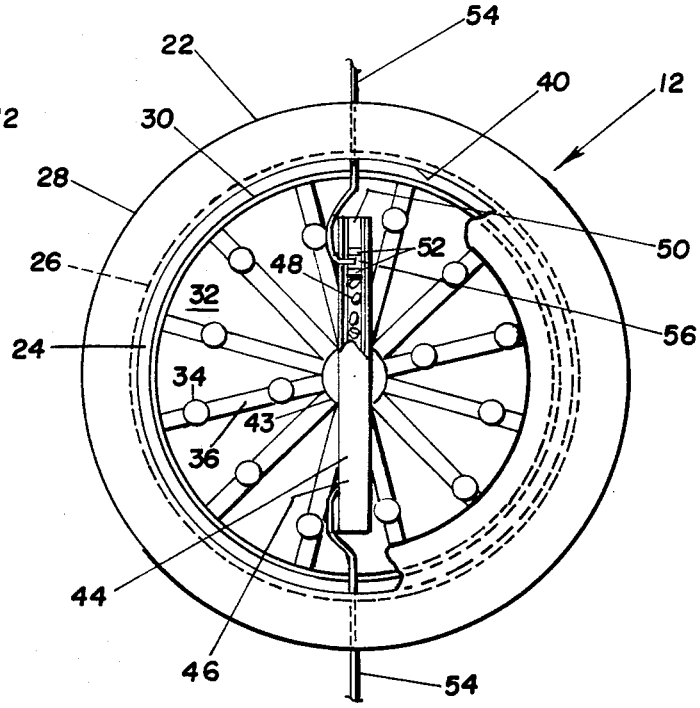
FIG. 3 is a view of the igniter taken along the lines 3—3 of FIG. 2.

As shown in FIGS. 2 and 3, the igniter 12 includes a thin, hat-shaped, urethane housing 22 having a disk 24 attached to one end of a short, hollow cylinder 26. A narrow flange 28 is provided at the other end of cylinder 26. A suitable bond 29, as seen in FIG. 1, is provided for attaching igniter 12 to the rocket motor propellant 16. Bonded to the inside of disk 24 with epoxy resin is a circular piece of woven fiber glass cloth 30. A flat, circular piece or disk of solid propellant 32 is partially bonded to the fiber glass cloth 30. For sustaining ignition in a vacuum (high altitude) environment, the material of which the solid propellant disk 32 is made preferably is a high-energy propellant having a rapid burning rate. A composition having particular utility for the purpose is that disclosed and claimed in the copending application Graham Shaw bearing U.S. Ser. No. 463,355 filed on even date herewith and including the following ingredients in substantially the proportions indicated below and also having the indicated casting properties:

| | Percentage by Weight |
|---|---|
| Ingredient | |
| Hydroxyl Terminated Polybutadiene | 12.7 |
| Acrylonitrile-Glycidol | 0.3 |
| Iron Oxide | 3.0 |
| Aluminum Powder | 10.0 |
| Ammonium Perchlorate (200 micron) | 33.0 |
| Ammonium Perchlorate (3.2 micron) | 40.0 |
| Octadecyl Isocyanate | 0.1 |
| Isophorone diisocyanate | 0.9 |
| | 100.0% |
| Casting Properties | |
| End-O-Mix - 3.2 kilopoise | |
| Pot Life - 6.5 hours | |

A plurality of holes 34 are formed in the propellant 32 to produce the required burning surface to support a specific mass flow rate. Radial grooves 36 are provided in the surface of the propellant 32 that faces the rocket motor propellant 16 to direct hot gases from the burning propellant through holes 38 in the cylindrical portion 26 of the housing 22.

The cylindrical portion 26 of the housing 22 is lined with a sheet 40 of EPDM. Sheet 40 has holes 42 that are in alignment with the centers of holes 38 in the cylindrical portion 26 of housing 22, the holes 38 being substantially larger than the holes 42, as shown in FIG. 2. The radial grooves 36 desirably have a depth of about one-half the thickness of propellant disc 32 to preclude blocking gas flow through holes 42 and 38. The smaller holes 42 in the sheet 40 may have a diameter of $\frac{1}{4}$ inch, for example, and perform the function of retaining the gas pressure within the housing 22 to sustain burning in a vacuum environment until the pressure is sufficiently great to project flaming gases onto the surface of the rocket propellant 16 over the required area. As the internal pressure becomes greater, the holes 42 in the sheet 40 expand, releasing the hot gases in a smoothly increasing volume, rather than with a sudden impulse. For facilitating bleed-off from top of the burning propellant disk 32, a large center hole 43 is provided therein.

An initiator, designated 44, for activating the igniter 12 comprises a perforated tubular urethane housing 46 that is filled with pellets 48 which are made of a mixture of boron and potassium nitrate. Each end of tube 46 is sealed with a plug of epoxy resin 50 that confines a pair of styrofoam disks 52. Sandwiched between each pair of disks 52 is the end of a Hivelite fuze 54 surrounded by boron and potassium nitrate in powder form 56. A Hivelite fuze is a product of Teledyne McCormick-Selth, 3601 Union Road P.0. Box 6, Hollister, Calif. and comprises a rapidly burning material that is encased in a lead sheath having a polyethylene jacket. Each fuze 54 has igniting connections to an ordnance initiator 58, as seen in FIG. 1 that is attached to the rocket motor case 14.

When it is desired to ignite the propellant 16 in the rocket motor 10, the ordnance initiators 58 are fired by an externally initiated, confined detonating fuze (not shown). This ignites the fuze 54 which in turn ignites the boron and potassium nitrate powder 56. This produces hot gases that break through the inner styrofoam disk of each pair of disks 20 of the fuze 54 to ignite the pellets 48 within the initiator tube 46. The resulting flaming gases are discharged through a row of holes 60 in the tube 46. The holes 60 in tube 46 are normally covered with aluminum tape 62 which contains the gas pressure within the tube 46 until the gas pressure is sufficiently high to ignite the propellant 32 effectively. The resulting gases are then forced through the orifices 42 and 38 in the housing 22 to ignite the rocket motor propellant 16. The igniter 12 is then consumed by combustion of the propellant 16 before the propellant 16, at the location of attachment of the igniter 12 thereto, becomes so eroded that the igniter 12 is no longer supported thereby and becomes detached therefrom.

Thus, there has been provided, according to the invention, a consumable wafer-like igniter having especial utility in igniting high-performance rocket motors having a full head-end web. The igniter is characterized in its release of hot gases for igniting the rocket motor propellant in a smoothly increasing volume, rather than with a sudden impulse, the release of hot gases being as close as possible to the surface being ignited, thereby to provide rapid and reliable ignition of the rocket motor propellant 16 before being consumed by combustion of the propellant 16 and before being detached therefrom.

What is claimed is:

1. An igniter for a rocket motor comprising, a hat-shaped housing having a disk attached to one end of a hollow cylinder having a flange at its other end for attachment of the igniter to the propellant of the rocket motor, said cylinder having a plurality of peripherally spaced holes therein, the inner surface of said cylinder being lined with an elastomer liner having holes therein in alignment with the holes in said cylinder, a circular piece of fiber glass cloth bonded to the inside of said disk of said housing, a flat, circular propellant disk partially bonded to said fiber glass cloth, said propellant disk having a plurality of holes therein to adjust mass flow rate of gases thereof, and having a plurality of radial grooves on a surface thereof to direct the burning propellant gases through the aligned peripheral holes in said cylinder and liner, and means to ignite said propellant disk.

2. An igniter for a rocket motor as specified in claim 1 wherein said radial grooves in said propellant are in alignment with the peripheral holes in said cylinder and said liner.

3. An igniter for a rocket motor as specified in claim 2 wherein said holes in said liner are normally smaller than the holes in said cylinder whereby upon burning of said propellant disk the smaller holes in said liner retain the gas pressure within the housing until it is sufficiently great to project flaming gases through said aligned peripheral holes, expansion of the holes in said liner as the pressure becomes greater releasing the hot gases in a smoothly increasing volume.

4. An igniter for a rocket motor as specified in claim 3 wherein said housing is made of urethane, said cylinder is short, and said flange is adapted for mounting the igniter on the rocket motor propellant grain with the surface of the propellant disk having said radial grooves facing the rocket motor propellant grain.

5. An igniter for a rocket motor as specified in claim 1 wherein said means to ignite said propellant disk comprises a tubular housing positioned adjacent said surface of said propellant disk, said tubular housing being filled with pellets made of boron and potassium nitrate, each end of said tubular housing being sealed with a plug of epoxy resin that confines a pair of styrofoam disks, a fuze and boron and potassium nitrate in powder form being sandwiched between each pair of styrofoam disks, and means for connecting each fuze to an ordnance initiator.

6. An igniter for a rocket motor as specified in claim 5 wherein said tubular housing for igniting said propellant disk is made of urethane and has a row of holes disposed lengthwise thereof, said tubular housing being consumed within the igniter.

7. An igniter for a rocket motor as specified in claim 6 wherein said row of holes in said tubular housing is normally covered with aluminum tape to contain the gas pressure within said tubular housing until it is sufficiently great to ignite said propellant disk effectively whereby the gases resulting from the burning of the propellant disk are forced through the aligned holes in said cylinder and said liner to ignite the propellant of the rocket motor.

8. An igniter for a rocket motor as specified in claim 7 wherein said holes in said liner are normally smaller than the holes in said cylinder whereby upon burning of said propellant disk the smaller holes in said liner retain the gas pressure within the housing until it is sufficiently great to project flaming gases through said aligned peripheral holes, expansion of the holes in said liner as the pressure becomes greater releasing the hot gases in a smoothly increasing volume.

9. A consumable wafer-like igniter for a rocket motor as specified in claim 1 wherein the composition of said propellant disk consists essentially of the following ingredients in the percentage by weight proportions indicated:

| Ingredient | % |
|---|---|
| Hydroxyl Terminated Polybutadiene | 12.7 |
| Acylonitrile-Glycidol | 0.3 |

-continued

| Ingredient | % |
|---|---|
| Iron Oxide | 3.0 |
| Aluminum Powder | 10.0 |
| Ammonium Perchlorate (200 micron) | 33.0 |
| Ammonium Perchlorate (3.2 micron) | 40.0 |
| Octadecyl Isocyanate | 0.1 |
| Isophorone diisocyanate | 0.9 |
| | 100.0% |

10. A consumable wafer-like igniter for a rocket motor comprising a hat-shaped housing made of urethane and having a disk attached to one end of a short hollow cylinder having a flange at its other end for attachment of the igniter to the propellant of the rocket motor, said cylinder having a plurality of peripherally spaced holes therein, the inner surface of said cylinder being lined with an elastomer having holes therein in alignment with the holes in said cylinder, the holes in said liner being normally smaller than the holes in said cylinder, a circular piece of fiber glass cloth bonded to the inside of said disk of said housing, a flat, circular propellant disk partially bonded to said fiber glass cloth, said propellant disk having a plurality of holes therein to adjust mass flow rate of propellant disk gases thereof and having a plurality of radial grooves in a surface thereof to direct the burning propellant gases through the aligned peripheral holes in said cylinder and liner, and means to ignite said propellant disk comprising a tubular housing made of urethane positioned adjacent the surface of said propellant disk having radial grooves therein, said tubular housing being filled with pellets made of boron and potassium nitrate, each end of said tubular housing being sealed with a plug of epoxy resin that confines a pair of styrofoam disks, a fuze and boron and potassium nitrate in powder form being sandwiched between each pair of styrofoam disks, said tubular housing normally being covered with aluminum tape to contain the gas pressure within said tubular housing until it is sufficiently great to ignite said propellant directly whereby the gases resulting from the burning of the propellant disk are forced through the aligned holes in said cylinder and said liner, the smaller holes in said liner retaining the gas pressure within said igniter housing until the pressure is sufficiently great to project flaming gases through said aligned holes, expansion of the holes in said liner as the pressure becomes greater releasing the hot gases in a smoothly increasing volume, and means for connecting said fuze to an ordnance initiator.

* * * * *